US010343003B2

(12) United States Patent
Baker et al.

(10) Patent No.: US 10,343,003 B2
(45) Date of Patent: Jul. 9, 2019

(54) AIRCRAFT FIRE SUPPRESSION SYSTEM AND METHOD

(71) Applicant: The Boeing Company, Chicago, IL (US)

(72) Inventors: Patrick T. Baker, Everett, WA (US); Douglas E. Ferguson, Dypress, CA (US); Mike R. Madden, Mount Vernon, WA (US)

(73) Assignee: The Boeing Company, Chicago, IL (US)

( * ) Notice: Subject to any disclaimer, the term of this patent is extended or adjusted under 35 U.S.C. 154(b) by 81 days.

(21) Appl. No.: 14/504,952

(22) Filed: Oct. 2, 2014

(65) Prior Publication Data

US 2016/0096051 A1 Apr. 7, 2016

(51) Int. Cl.

| | |
|---|---|
| ***A62C 3/08*** | (2006.01) |
| ***A62C 37/36*** | (2006.01) |
| ***A62C 99/00*** | (2010.01) |
| ***A62C 35/02*** | (2006.01) |

(52) U.S. Cl.

CPC ..... *A62C 3/08* (2013.01); *A62C 35/02* (2013.01); *A62C 37/36* (2013.01); *A62C 99/0018* (2013.01); *A62C 35/023* (2013.01)

(58) Field of Classification Search

CPC ..... A62C 3/08; A62C 35/02; A62C 35/11; A62C 35/13

USPC ..... 169/14, 46, 53

See application file for complete search history.

(56) References Cited

U.S. PATENT DOCUMENTS

| | | | | | |
|---|---|---|---|---|---|
| 4,482,018 | A | * | 11/1984 | Enk | A62C 3/08 169/62 |
| 4,643,260 | A | * | 2/1987 | Miller | A62C 3/08 169/46 |
| 4,726,426 | A | * | 2/1988 | Miller | A62C 99/0018 169/16 |
| 5,038,867 | A | * | 8/1991 | Hindrichs | A62C 35/58 169/62 |
| 5,759,430 | A | * | 6/1998 | Tapscott | A62D 1/005 169/45 |
| 5,799,735 | A | * | 9/1998 | Sundholm | A62C 5/022 169/13 |

(Continued)

FOREIGN PATENT DOCUMENTS

WO WO1991005585 5/1991

OTHER PUBLICATIONS

U.S. Department of Transportation, Prevention of a Sumulated Aerosol Can Explosion with Mixture of Halon 1301 and Nitrogen, Nov. 2008, U.S. Department of Transportation, all pages.*

(Continued)

*Primary Examiner* — Arthur O. Hall
*Assistant Examiner* — Joseph A Greenlund
(74) *Attorney, Agent, or Firm* — Walters & Wasylyna LLC

(57) ABSTRACT

A fire suppression system for an aircraft having a compartment, the fire suppression system including an inert gas source in selective fluid communication with the compartment and a fire suppression agent source in selective fluid communication with the compartment, wherein an inert gas from the inert gas source and a fire suppression agent from the fire suppression agent source are at least partially combined to form a fire suppression mixture.

22 Claims, 3 Drawing Sheets

(56) References Cited

U.S. PATENT DOCUMENTS 7,066,274 B2 * 6/2006 Lazzarini ..... A62C 3/08 169/16
7,806,195 B2 * 10/2010 Popp ..... A62C 3/08 169/14
7,849,931 B2 * 12/2010 Ng ..... A62C 3/08 169/16
7,900,709 B2 * 3/2011 Kotliar ..... A62C 3/0221 169/14
8,256,524 B2 * 9/2012 Bleil ..... A62C 3/08 169/11
8,261,844 B2 * 9/2012 Itano ..... A62C 13/66 169/78
8,360,162 B2 * 1/2013 Lelic ..... A62C 99/0018 169/11
8,613,325 B2 * 12/2013 Guse ..... A62C 5/02 137/88
8,678,101 B2 * 3/2014 Gatsonides ..... A62C 3/08 169/62
8,733,463 B2 * 5/2014 Meier ..... A62C 99/0018 169/46
8,813,858 B2 * 8/2014 Gatsonides ..... A62C 3/07 169/11
8,925,642 B2 * 1/2015 Meier ..... A62C 3/08 169/47
8,925,865 B2 * 1/2015 Stolte ..... B64D 25/00 169/46
8,973,670 B2 * 3/2015 Enk, Sr. ..... A62C 3/08 169/14
9,033,061 B2 * 5/2015 Chattaway ..... A62C 37/44 169/11
2011/0308823 A1 * 12/2011 Seebaluck ..... A62C 37/36 169/46
2012/0031634 A1 * 2/2012 Lewinski ..... A62C 3/08 169/62
2012/0217027 A1 * 8/2012 Chattaway ..... A62C 99/0018 169/46
2013/0217784 A1 * 8/2013 Singh ..... A62D 1/0057 514/744
2014/0158382 A1 * 6/2014 Ferguson ..... A62C 3/08 169/46
2016/0023034 A1 * 1/2016 Elsheikh ..... C07C 17/389 252/68

OTHER PUBLICATIONS

Zou et al., "Fire Protection with Bromoalkene/Nitrogen Gaseous Mixtures," *Ind. Eng. Chem*, vol. 40, pp. 4649-4653 (2001).
Linteris et al., "Unwanted Combustion Enhancement in the FAA Aerosol Can Test by C3H2F3Br (2-BTP) Fire Suppressant," *Proceedings of the Combustion Institute*, vol. 35 (2013).
Reinhart, "Minimum Performance Standards for Aircraft Cargo Compartment Halon Replacement Fire Suppression Systems," FAA Report No. DOT/FAA/TC-TN12/11 (2012).
Reinhart, "Behavior of Bromotrifluoropropene and Pentafluoroethane When Subjected to a Simulated Aerosol Can Explosion," FAA Report No. DOT/FAA/AR-TN04/4 (2004).
Christian et al., "Synergism in Flame Extinguishment: New Results for Mixtures of Physical and Chemical Agents," Halon Options Technical Working Conference (1997).

* cited by examiner

AIRCRAFT FIRE SUPPRESSION SYSTEM AND METHOD

FIELD

This application relates to fire suppression and, more particularly, to the suppression of fires in aircraft compartments.

BACKGROUND

Aircraft, particularly commercial passenger aircraft, are commonly equipped with a fire protection system in the cargo compartment. A typical fire protection system comprises two sub-systems: a fire detection system and a fire suppression system. The fire detection system includes one or more fire detectors (e.g., smoke detectors) and the fire suppression system includes a fire suppression agent. When a fire is detected in the cargo compartment, the fire suppression agent is released and floods the cargo compartment with an appropriate quantity of the fire suppression agent. The release of the fire suppression agent may occur automatically in response to a positive fire detection by a fire detector or, alternatively, may occur in response to manual pilot intervention (e.g., after the pilot receives a warning signal and actuates one or more switches).

Halon 1301 (bromotrifluoromethane) has long been the fire suppression agent of choice on aircraft. Halon 1301 is a clean fire suppression agent; it does not damage cargo or leave behind a residue. Furthermore, unlike inert gas-based fire suppression agents, such as carbon dioxide, Halon 1301 is effective in suppressing fires at relatively low concentrations (e.g., 3 to 10 percent by volume). Therefore, a breathable level of oxygen may remain after discharge of Halon 1301.

Halon 1301 has a relatively high ozone depletion potential ("ODP") and alternatives are being sought out. Several alternatives to Halon 1301 have been proposed, such as 2-bromo-3,3,3-trifluoro-1-propene. However, the alternatives proposed to date have been unsuitable for aircraft use because they cannot pass the United States Federal Aviation Administration's Aerosol Can Explosion Simulation Test, which is outlined in the Federal Aviation Administration's Minimum Performance Standard for Aircraft Cargo Compartment Halon Replacement Fire Suppression Systems, 2012 Update (DOT/FAA/TC-TN12/11).

Accordingly, those skilled in the art continue with research and development efforts in the field of aircraft fire suppression.

SUMMARY

In one aspect, the disclosed aircraft may include a compartment (e.g., a cargo compartment) and a fire suppression system, wherein the fire suppression system includes an inert gas source in selective fluid communication with the compartment and a fire suppression agent source in selective fluid communication with the compartment, wherein an inert gas from the inert gas source and a fire suppression agent from the fire suppression agent source are at least partially combined to form a fire suppression mixture.

In another aspect, the disclosed fire suppression system for an aircraft having a compartment (e.g., a cargo compartment) may include a nozzle positioned in the compartment, a conduit network including a main line fluidly coupled with the nozzle, a first supply line fluidly coupled with the main line and a second supply line fluidly coupled with the main line, an inert gas source in fluid communication with the main line by way of the first supply line, and a fire suppression agent source in fluid communication with the main line by way of the second supply line.

In yet another aspect, the disclosed method for suppressing a fire in a compartment of an aircraft may include the steps of (1) monitoring the compartment for presence of a fire and (2) after the fire is detected, simultaneously introducing into the compartment a first volume of an inert gas and a second volume of a fire suppression agent.

Other aspects of the disclosed aircraft fire suppression system and method will become apparent from the following detailed description, the accompanying drawings and the appended claims.

DETAILED DESCRIPTION

Various aircraft may be equipped with the disclosed aircraft fire suppression system. While a fixed-wing aircraft 100 is shown in FIG. 1, non-fixed wing aircraft, such as rotary-wing aircraft (rotorcraft), may also benefit from the disclosed aircraft fire suppression system and method.

Figure 1:
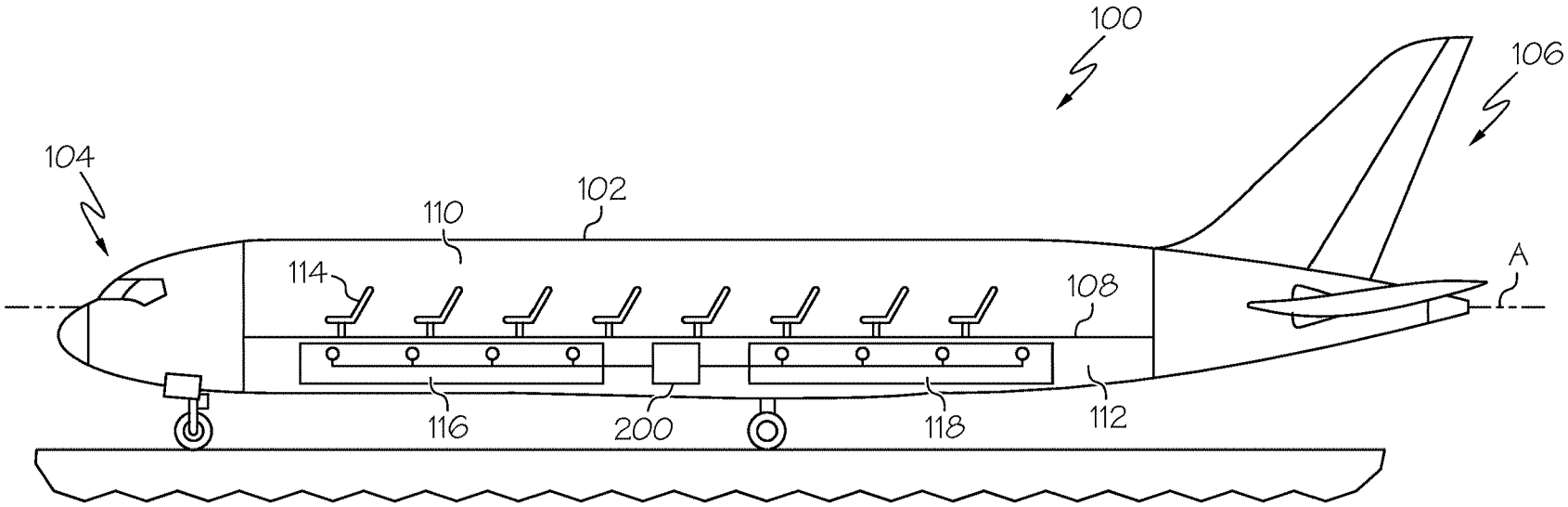
FIG. 1 is a side elevational view of an aircraft equipped with the disclosed aircraft fire suppression system.

Referring to FIG. 1, one aspect of the disclosed aircraft, generally designated 100, may include a fuselage 102 that longitudinally extends along an axis A from proximate a front end 104 of the aircraft 100 to proximate a rear end 106 of the aircraft 100. A support floor 108 may extend from proximate (at or near) the front end 104 of the aircraft 100 to proximate the rear end 106 of the aircraft 100, thereby defining a passenger compartment 110 and a cargo compartment 112 within the fuselage 102.

The passenger compartment 110 may include a plurality of seats 114 affixed to the floor 108. Various additional features, such as carryon baggage storage compartments and the like, are well known in the art and may be included in the passenger compartment 110 without departing from the scope of the present disclosure.

The cargo compartment 112 may be divided into a forward compartment 116 and an aft compartment 118. The forward compartment 116 and the aft compartment 118 may provide a generally open area for holding various containers, bulk cargo and the like. One or more cargo doors (not shown) may provide access to the forward and aft compartments 116, 118 of the cargo compartment 112.

In one variation, the cargo compartment 112 may be a single compartment (not a divided compartment). In another variation, the cargo compartment 112 may be divided into three of more compartments, such as a forward compartment, a middle compartment and an aft compartment.

The cargo compartment 112, specifically the forward and aft compartments 116, 118, of the aircraft 100 may be equipped with an aircraft fire suppression system 200. As is described in greater detail herein, in the event of a fire in the cargo compartment 112, the aircraft fire suppression system 200 may supply to the cargo compartment 112 a fire suppression mixture that includes an inert gas and a fire suppression agent.

Figure 2:
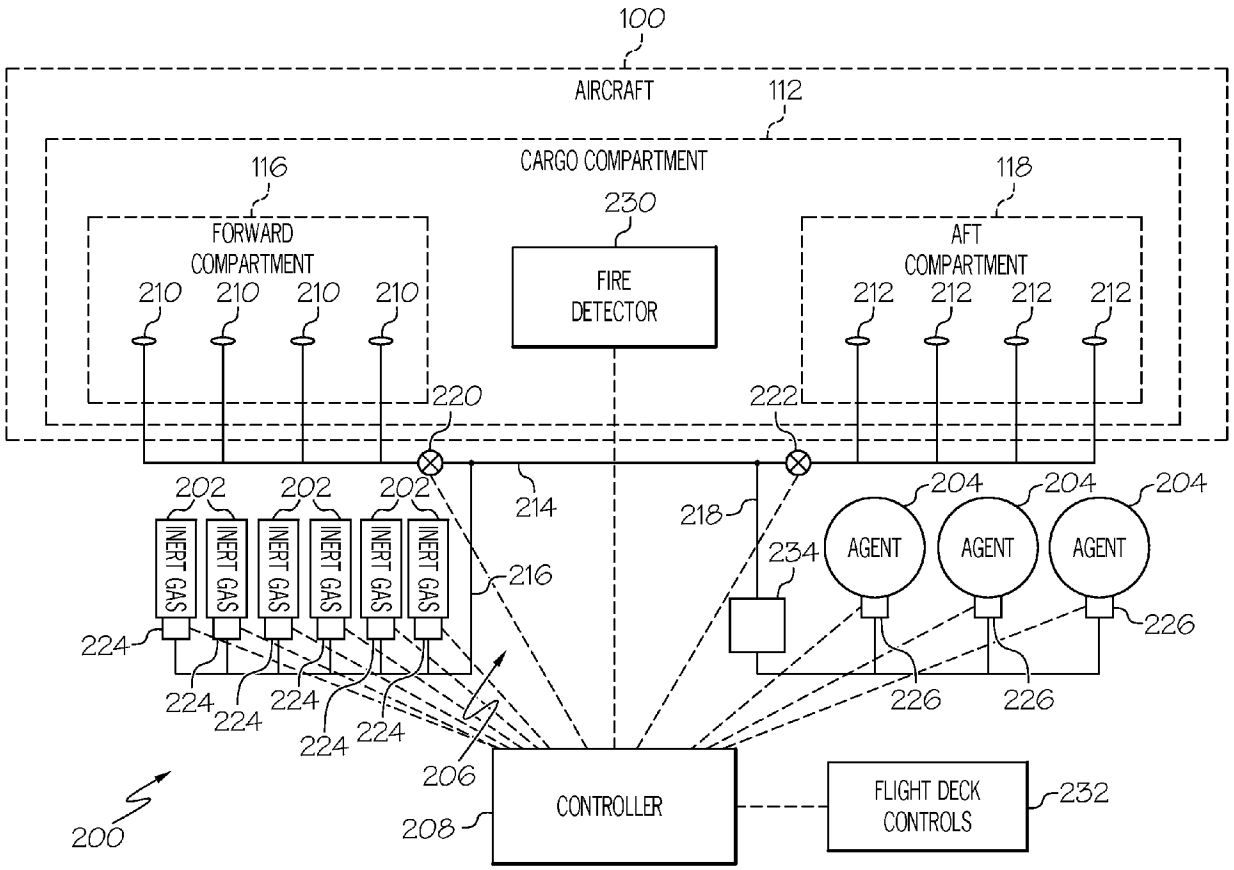
FIG. 2 is a schematic flow diagram depicting one aspect of the disclosed aircraft fire suppression system.

Referring to FIG. 2, one aspect of the disclosed aircraft fire suppression system, generally designated 200, may include an inert gas source 202, a fire suppression agent source 204, a conduit network 206 and a controller 208. The controller 208 may effect simultaneous release (to the cargo compartment 112 of the aircraft 100) of inert gas from the inert gas source 202 and fire suppression agent from the fire suppression agent source 204, thereby forming a fire suppression mixture effective against fire.

The inert gas source 202 may be any source capable of supplying a quantity of inert gas sufficient to form the disclosed fire suppression mixture. While six separate inert gas sources 202 are shown in FIG. 2, fewer inert gas sources 202 (e.g., only one) or additional inert gas sources 202 (e.g., seven or more) may be used without departing from the scope of the present disclosure. For example, the number of inert gas sources 202 may depend of the number of compartments within the cargo compartment 112.

The inert gas supplied by the inert gas source 202 may be any inorganic gas that does not readily participate in combustion reactions. The inert gas may be elemental or a compound. As one specific, non-limiting example, the inert gas from inert gas source 202 may consist essentially of a noble gas, such as helium or argon. As another specific, non-limiting example, the inert gas from inert gas source 202 may consist essentially of nitrogen. Using mixtures of inert gases is also contemplated.

In one variation, the inert gas source 202 may include a pressurized vessel housing an initial quantity of the inert gas. For example, the inert gas source 202 may be a gas cylinder (e.g., a metallic gas cylinder) filled with pressurized inert gas (e.g., nitrogen and/or argon).

In another variation, the inert gas source 202 may include a solid propellant gas generator (SPGG). The solid propellant gas generator may store inert gas as a solid material, and may rapidly release inert gas when the solid material is combusted. As one specific, non-limiting example, the solid propellant gas generator may contain a quantity of sodium azide ($NaN_3$) that, when ignited, produces sodium metal and nitrogen gas. Use of a liquid propellant is also contemplated.

In yet another variation, the inert gas source 202 may include an on-board inert gas generation system (OBIGGS). The aircraft 100 may include an on-board inert gas generation system in connection with its fuel system, as is commonly done on modern aircraft to inert the fuel tank during flight. For example, the on-board inert gas generation system may employ a membrane separation technique to separate nitrogen from ambient air. Therefore, the on-board inert gas generation system of the aircraft 100 may be tapped as the inert gas source 202 of the disclosed aircraft fire suppression system 200.

The fire suppression agent source 204 may be any source capable of supplying a quantity of fire suppression agent sufficient to form the disclosed fire suppression mixture. While three separate fire suppression agent sources 204 are shown in FIG. 2, fewer fire suppression agent sources 204 (e.g., only one) or additional fire suppression agent sources 204 (e.g., four or more) may be used without departing from the scope of the present disclosure. For example, the number of fire suppression agent sources 204 may depend of the number of compartments within the cargo compartment 112.

The fire suppression agent supplied by the fire suppression agent source 204 may be any chemically active (non-inert) agent effective in fire suppression. Without being limited to any particular theory, it is believed that chemically active fire suppression agents suppress combustion by sequestering free radicals that propagate the combustion reaction. However, selection of a fire suppression agent to be contained in the fire suppression agent source 204 is not limited to any particular chemical mechanism. The fire suppression agent may be a liquid (e.g., a volatile liquid) or a gas at standard temperature and pressure.

In one particular implementation, the fire suppression agent supplied by the fire suppression agent source 204 may be (or may include) an organofluorine compound. Specific examples of organofluorine compounds suitable for use as the fire suppression agent supplied by the fire suppression agent source 204 include, but are not limited to, 2-bromo-3,3,3-trifluoro-1-propene (2-BTP), 1,1,1,2,2-pentafluoroethane (HFC-125), and perfluoro(2-methyl-3-pentanone) (NOVEC™ 1230, commercially available from 3M Company of St. Paul, Minn.).

The fire suppression agent source 204 may include a pressurized vessel housing an initial quantity of the fire suppression agent. For example, the fire suppression agent source 204 may be a cylinder (e.g., a metallic cylinder) filled with fire suppression agent. When the fire suppression agent is a liquid at standard temperature and pressure, the fire suppression agent may be pressurized with a small quantity of inert gas (e.g., nitrogen).

The conduit network 206 may fluidly couple the inert gas source 202 and the fire suppression agent source 204 with nozzles 210, 212 in the cargo compartment 112 of the aircraft 100. The nozzles 210, 212 may be configured and arranged to quickly and effectively distribute the fire suppression mixture throughout the cargo compartment 112. For example, one or more nozzles 210 may be positioned in the forward compartment 116 of the cargo compartment 112 and one or more nozzles 212 may be positioned in the aft compartment 118 of the cargo compartment 112. Additional nozzles may be included when the cargo compartment 112 includes compartments in addition to the forward and aft compartments 116, 118. Fewer nozzles may be included when the cargo compartment 112 includes only a single compartment.

The conduit network 206 may include a main line 214, a first supply line 216 and a second supply line 218. The main line 214 of the conduit network 206 may fluidly couple the first supply line 216 and the second supply line 218 with the cargo compartment 112 (e.g., with the nozzles 210, 212). The first supply line 216 may fluidly couple the inert gas source 202 with the main line 214. The second supply line 218 may fluidly couple the fire suppression agent source 204 with the main line 214. Various additional conduits may be included in the conduit network 206 to facilitate the simultaneous release to the cargo compartment 112 of the inert gas and the fire suppression agent.

One or more flow control devices 220, 222 may be positioned on the main line 214 to control the flow of fluid along the main line 214. For example, flow control device 220 may control the flow of fluid to the forward compartment 116 of the cargo compartment 112 and flow control device 222 may control the flow of fluid to the aft compartment 118 of the cargo compartment 112. Additional flow control devices may be included when the cargo compartment 112 includes compartments in addition to the forward and aft compartments 116, 118. Fewer flow control devices (e.g., only one or none) may be included when the cargo compartment 112 includes only a single compartment.

The flow control devices 220, 222 of the main line 214 may be in communication with, and actuateable by, the controller 208. For example, the flow control devices 220, 222 may be electronically actuateable valves, such as normally-closed solenoid valves or normally-open solenoid valves. Therefore, the flow control devices 220, 222 may selectively provide (or, alternatively, may selectively prevent) fluid communication with the cargo compartment 112 when actuated by the controller 208.

A first flow control device 224 may be associated with each inert gas source 202 to control the flow of inert gas from the inert gas source 202 to the first supply line 216 and, ultimately, to the cargo compartment 112 by way of the main line 214. The type of flow control device 224 used may depend on the type of inert gas source 202 being used. As one example, when the inert gas source 202 is a pressurized vessel, the first flow control device 224 may be an electronically actuateable valve, such as a normally-closed solenoid valve. As another example, when the inert gas source 202 includes a solid propellant gas generator, the first flow control device 224 may be (or may include) an electrical discharge cartridge (e.g., a squib) that, when electronically actuated, ignites the solid propellant gas generator and fluidly couples the solid propellant gas generator with the first supply line 216.

A second flow control device 226 may be associated with each fire suppression agent source 204 to control the flow of fire suppression agent from the fire suppression agent source 204 to the second supply line 218 and, ultimately, to the cargo compartment 112 by way of the main line 214. As one example, the second flow control device 226 may be (or may include) an electronically actuateable valve, such as normally-closed solenoid valve. As another example, the second flow control device 226 may be (or may include) an electrical discharge cartridge (e.g., a squib) designed to rupture a seal when actuated.

The first and second flow control devices 224, 226 may be in communication with, and actuateable by, the controller 208. Therefore, the first flow control device 224 may selectively provide fluid communication between the inert gas source 202 and the first supply line 216 when actuated by the controller 208 and the second flow control device 226 may selectively provide fluid communication between the fire suppression agent source 204 and the second supply line 218.

Thus, when the controller 208 actuates the first and second flow control devices 224, 226, inert gas from the inert gas source 202 may flow into the first supply line 216 and fire suppression agent from the fire suppression agent source 204 may flow into the second supply line 218. In the conduit network 206 (e.g., within the main line 214), the inert gas may mix with the fire suppression agent to form the fire suppression mixture, which may then pass into the cargo compartment 112 by way of the nozzles 210, 212.

In an alternative aspect, when the controller 208 actuates the first and second flow control devices 224, 226, mixing of the inert gas with the fire suppression agent to form the fire suppression mixture may occur in the cargo compartment 112 rather than within the conduit network 206. For example, one nozzle 210, 212 may release the inert gas into the cargo compartment 112, while another nozzle 210, 212 may release the fire suppression agent, thereby allowing the inert gas to mix with the fire suppression agent within the cargo compartment 112.

A fire detector 230 may be provided in the cargo compartment 112 of the aircraft 100. While the fire detector 230 is shown in FIG. 2 generally positioned in the cargo compartment 112, each compartment (e.g., forward compartment 116 and aft compartment 118) of the cargo compartment 112 may have a dedicated fire detector 230 (or plural dedicated fire detectors).

The fire detector 230 may be (or may include) any apparatus or system capable of detecting smoke and/or fire. For example, the fire detector may be (or may include) a smoke detector, such as an optical smoke detector and/or an ionization smoke detector.

When the fire detector 230 detects a fire, the controller 208 may initiate a fire suppression sequence, which may include actuating the first and second flow control devices 224, 226, as well as one or more of flow control devices 220, 222, as appropriate. In one configuration, the controller 208 may automatically initiate the fire suppression sequence when the fire detector 230 detects a fire. In another configuration, the fire detector 230 may trigger a warning (e.g., a visual and/or audible indication) to the pilot when a fire is detected. However, the controller 208 may not initiate the fire suppression sequence until the controller 208 receives a command from the pilot, such as when the pilot manually engages one or more flight deck controls 232 (e.g., switches).

The cargo compartment 112 of the aircraft 100 may have a known volume, and may be filled with air (e.g., ambient air). The inert gas source 202 may be charged to yield a first quantity of inert gas and the fire suppression agent source 204 may be charged to yield a second quantity of fire suppression agent. Therefore, when the first quantity of inert gas and the second quantity of fire suppression agent are introduced into the cargo compartment 112, an inerting concentration of fire suppression agent may be present in the cargo compartment 112. Additionally, the first quantity of inert gas may be sufficient to displace air (specifically, oxygen) and correspondingly, enrich the fire suppression agent-to-oxygen volumetric ratio within the cargo compartment 112, thereby yielding a fire suppression mixture capable of passing the United States Federal Aviation Administration's Aerosol Can Explosion Simulation Test.

The fire suppression mixture may deliver a quantity of fire suppression agent sufficient to achieve within the cargo compartment 112 at least an inerting concentration of fire suppression agent. The inerting concentration of fire suppression agent may depend on the composition of the fire suppression agent. The inerting concentration for a particular fire suppression agent may be experimentally determined using various techniques. For example, when 2-bromo-3,3,3-trifluoro-1-propene is used as the fire suppression agent, a concentration of at least about 8.5 percent by volume may be required to be inerting.

Furthermore, the fire suppression mixture may synergistically deliver a quantity of inert gas sufficient to achieve within the cargo compartment 112 an added concentration of inert gas. As used herein, "added concentration" refers to the inert gas introduced to the cargo compartment 112 from the inert gas source 202, and does not include any inert gas that may be initially present (e.g., in the ambient air) in the cargo compartment 112. For example, when the inert gas is nitrogen, the added concentration of nitrogen only accounts for the nitrogen supplied from the inert gas source 202, and does not take into account the nitrogen already present in the cargo compartment by virtue of the fact that ambient air comprises a significant quantity (about 78 percent by volume) of nitrogen.

In one expression, the fire suppression mixture may deliver a quantity of inert gas sufficient to achieve within the cargo compartment 112 an added concentration of inert gas ranging from about 15 to about 19 percent by volume. In another expression, the fire suppression mixture may deliver a quantity of inert gas sufficient to achieve within the cargo compartment 112 an added concentration of inert gas ranging from about 16 to about 18 percent by volume. In yet another expression, the fire suppression mixture may deliver a quantity of inert gas sufficient to achieve within the cargo compartment 112 an added concentration of inert gas of about 17 percent by volume.

Thus, the inert gas source 202 and the fire suppression agent source 204 may be charged with sufficient quantities of inert gas and fire suppression agent, respectfully, to achieve within the cargo compartment 112 an added concentration of inert gas and an inerting concentration of fire suppression agent, which may allow the fire suppression mixture to prevent an explosion in the Unites States Federal Aviation Administration's Aerosol Can Explosion Simulation Test.

The entire payload of inert gas and fire suppression agent may be delivered simultaneously from the inert gas source 202 and the fire suppression agent source 204. Alternatively, a sequential release of inert gas and/or fire suppression agent may be used. For example, the first two inert gas sources 202 may be actuated with the first fire suppression agent source 204, then after expiration of a first predetermined time interval the next two inert gas sources 202 may be actuated with the next fire suppression agent source 204, then after expiration of a second predetermined time interval the final two inert gas sources 202 may be actuated with the final fire suppression agent source 204.

Optionally, a regulator 234 may be positioned on the second supply line 218 to regulate the flow of fire suppression agent from the fire suppression agent source 204. For example, the regulator 234 may be configured to regulate the flow rate of fire suppression agent based on the flow rate of the inert gas such that the resulting fire suppression mixture has the desired composition.

Accordingly, by simultaneously charging the cargo compartment 112 of the aircraft 100 with inert gas and fire suppression agent to achieve an inerting concentration of fire suppression agent and an added concentration of inert gas, the resulting fire suppression mixture may be capable of substitution for Halon 1301-based systems.

Figure 3:
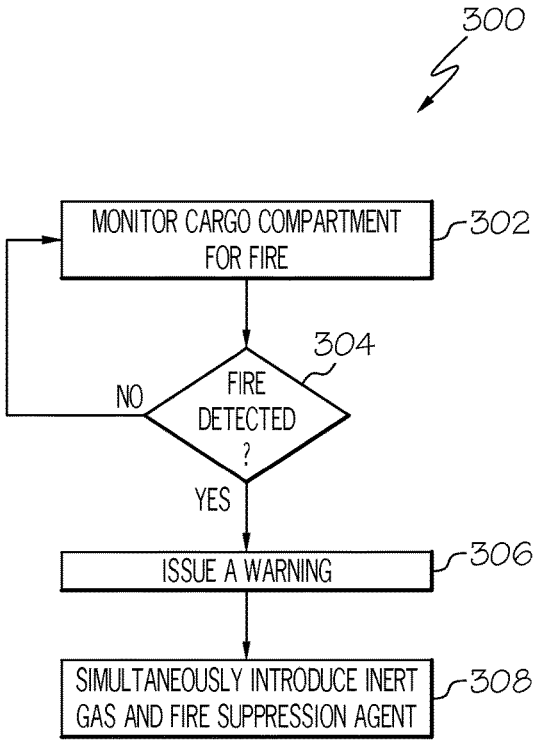
FIG. 3 is a flowchart depicting one aspect of the disclosed aircraft fire suppression method.

Also disclosed is an aircraft fire suppression method. As shown in FIG. 3, one aspect of the disclosed aircraft fire suppression method, generally designated 300, may begin at Block 302 with the step of monitoring a compartment of an aircraft for the presence of fire. For example, the cargo compartment of the aircraft may be provided with one or more fire detectors (e.g., smoke detectors).

At Block 304, the method 300 may query whether a fire has been detected. If no fire is detected, the method 300 may return to Block 302 to continue to monitor for the presence of fire in the compartment. However, when a fire is detected, the method 300 may proceed to the next step.

At Block 306, an optional warning may be issued when a fire is detected (at Block 304). The warning may be issued to the pilot of the aircraft. For example, the warning may include a visual and/or audible indication that a fire has been detected. The warning may prompt pilot intervention.

At Block 308, an inert gas and a fire suppression agent may be simultaneously released into the compartment of the aircraft. The release may be automatic or in response to a command from the pilot. The simultaneous release of inert gas and fire suppression agent may yield within the compartment an added concentration of inert gas (e.g., about 15 to about 19 percent by volume) and an inerting concentration of fire suppression agent.

Although various aspects of the disclosed aircraft fire suppression system and method have been shown and described, modifications may occur to those skilled in the art upon reading the specification. The present application includes such modifications and is limited only by the scope of the claims.

What is claimed is:

1. An aircraft comprising:

a cargo compartment; and a fire suppression system comprising:

an inert gas source in selective fluid communication with said cargo compartment, said inert gas source supplying a first volume of an inert gas sufficient to achieve in said cargo compartment an added concentration of said inert gas ranging from about 15 percent to about 19 percent by volume; and a fire suppression agent source in selective fluid communication with said cargo compartment, said fire suppression agent source supplying a second volume of a fire suppression agent, said fire suppression agent comprising at least one of 2-bromo-3,3,3-trifluoro-1-propene, 1,1,1,2,2-pentafluoroethane, and perfluoro(2-methyl-3-pentanone), wherein said second volume of said fire suppression agent has a magnitude such that a fire suppression mixture comprising said first volume of said inert gas and said second volume of said fire suppression agent, when supplied to said cargo compartment, is effective against fire and prevents an explosion in an aerosol can explosion simulation test as said aerosol can explosion simulation test is defined in United States Federal Aviation Administration document DOT/FAA/TC-TN12/11 dated May, 2012.

2. The aircraft of claim 1 wherein said fire suppression system further comprises a nozzle positioned in said cargo compartment, wherein said fire suppression mixture is introduced to said cargo compartment by way of said nozzle.

3. The aircraft of claim 2 wherein said fire suppression system further comprises a conduit network comprising:

a main line fluidly coupled with said nozzle;

a first supply line fluidly coupling said inert gas source with said main line; and a second supply line fluidly coupling said fire suppression agent source with said main line.

4. The aircraft of claim 3 wherein said fire suppression system further comprises:

a first flow control device on said first supply line; and a second flow control device on said second supply line.

5. The aircraft of claim 4 wherein said fire suppression system further comprises a controller in communication with said first flow control device and said second flow control device, wherein said first flow control device and said second flow control device are actuatable by said controller.

6. The aircraft of claim 5 wherein said fire suppression system further comprises a fire detector in communication with said controller.

7. The aircraft of claim 5 wherein said fire suppression system further comprises a flight deck control in communication with said controller.

8. The aircraft of claim 3 wherein said cargo compartment comprises a forward compartment and an aft compartment, and wherein said main line is in fluid communication with said forward compartment and said aft compartment.

9. The aircraft of claim 8 wherein said fire suppression system further comprises at least one flow control device positioned on said main line to direct flow of said fire suppression mixture to at least one of said forward compartment and said aft compartment.

10. The aircraft of claim 1 wherein said inert gas source comprises at least one of a pressurized vessel, a solid propellant gas generator, and an on-board inert gas generation system.

11. The aircraft of claim 1 wherein said inert gas consists essentially of nitrogen.

12. The aircraft of claim 1 wherein said fire suppression agent source comprises a pressurized vessel.

13. The aircraft of claim 1 wherein said fire suppression agent comprises 2-bromo-3,3,3-trifluoro-1-propene.

14. A fire suppression system for an aircraft, said aircraft comprising a cargo compartment, said fire suppression system comprising:

a nozzle positioned in said cargo compartment;

a conduit network comprising:

a main line fluidly coupled with said nozzle;

a first supply line fluidly coupled with said main line; and a second supply line fluidly coupled with said main line;

an inert gas source in fluid communication with said main line by way of said first supply line, said inert gas source supplying a first volume of inert gas sufficient to achieve an added concentration of said inert gas in said cargo compartment ranging from about 15 percent to about 19 percent by volume; and a fire suppression agent source in fluid communication with said main line by way of said second supply line, said fire suppression agent source supplying a second volume of a fire suppression agent comprising at least one of 2-bromo-3,3,3-trifluoro-1-propene, 1,1,1,2,2-pentafluoroethane, and perfluoro(2-methyl-3-pentanone), wherein said second volume of said fire suppression agent has a magnitude such that a fire suppression mixture comprising said first volume of said inert gas and said second volume of said fire suppression agent, when supplied to said cargo compartment, is effective against fire and prevents an explosion in an aerosol can explosion simulation test as said aerosol can explosion simulation test is defined in United States Federal Aviation Administration document DOT/FAA/TC-TN12/11 dated May, 2012.

15. The fire suppression system of claim 14 wherein said inert gas consists essentially of nitrogen.

16. The fire suppression system of claim 14 wherein said fire suppression agent comprises 2-bromo-3,3,3-trifluoro-1-propene.

17. The aircraft of claim 14 wherein said inert gas source comprises an on-board inert gas generation system.

18. A method for suppressing a fire in a cargo compartment of an aircraft, said method comprising:

monitoring said cargo compartment for presence of a fire; and after said fire is detected, simultaneously introducing into said cargo compartment a first volume of an inert gas and a second volume of a fire suppression agent comprising at least one of 2-bromo-3,3,3-trifluoro-1-propene, 1,1,1,2,2-pentafluoroethane, and perfluoro(2-methyl-3-pentanone), wherein said first volume has a magnitude that yields an added concentration of said inert gas in said cargo compartment ranging from about 15 percent to about 19 percent by volume, and wherein said second volume has a magnitude such that a fire suppression mixture comprising said first volume of said inert gas and said second volume of said fire suppression agent, when supplied to said cargo compartment, is effective against fire and prevents an explosion in an aerosol can explosion simulation test, as said aerosol can explosion simulation test is defined in United States Federal Aviation Administration document DOT/FAA/TC-TN12/11 dated May, 2012.

19. The method of claim 18 further comprising issuing a warning when said fire is detected.

20. The method of claim 18 wherein said simultaneously introducing step is automatically performed when said fire is detected.

21. The method of claim 18 wherein said inert gas consists essentially of nitrogen.

22. The method of claim 18 wherein said fire suppression agent comprises 2-bromo-3,3,3-trifluoro-1-propene.

* * * * *